US010944206B1

(12) United States Patent
Guerin

(10) Patent No.: US 10,944,206 B1
(45) Date of Patent: Mar. 9, 2021

(54) ELECTRICAL CONNECTOR SYSTEM WITH A LATCH THAT PERMITS ROTATION OF CONNECTOR HOUSINGS INTO ELECTRICAL CONNECTION

(71) Applicant: OPDO Connectors, LLC, West Chester, PA (US)

(72) Inventor: Daniel Guerin, West Chester, PA (US)

(73) Assignee: OPDO Connectors, LLC, West Chester, PA (US)

( * ) Notice: Subject to any disclaimer, the term of this patent is extended or adjusted under 35 U.S.C. 154(b) by 0 days.

(21) Appl. No.: 16/716,810

(22) Filed: Dec. 17, 2019

Related U.S. Application Data

(60) Provisional application No. 62/780,685, filed on Dec. 17, 2018.

(51) Int. Cl.

| | |
|---|---|
| ***H01R 13/629*** | (2006.01) |
| ***H01R 13/52*** | (2006.01) |
| ***H01R 13/502*** | (2006.01) |
| ***H01R 13/627*** | (2006.01) |
| ***H01R 13/645*** | (2006.01) |

(52) U.S. Cl.
CPC ..... *H01R 13/5221* (2013.01); *H01R 13/502* (2013.01); *H01R 13/629* (2013.01); *H01R 13/6272* (2013.01); *H01R 13/6456* (2013.01)

(58) Field of Classification Search
CPC ..... H01R 13/6271; H01R 13/6272; H01R 13/6273; H01R 13/629; H01R 13/64; H01R 13/6456
See application file for complete search history.

(56) References Cited

U.S. PATENT DOCUMENTS

| | | | |
|---|---|---|---|
| 2,819,914 | A | 1/1958 | Eitner |
| 2,858,518 | A | 10/1958 | Chyrstie |
| 2,987,691 | A | 6/1961 | Ross |
| 3,068,188 | A | 4/1963 | Ross |
| 3,129,993 | A | 4/1964 | Ross |
| 3,193,311 | A | 7/1965 | Gordan |
| 3,573,710 | A | 4/1971 | Wofford |
| 3,729,699 | A | 4/1973 | Briggs et al. |

(Continued)

FOREIGN PATENT DOCUMENTS

EP 2937616 A1 10/2015

*Primary Examiner* — Vanessa Girardi
(74) *Attorney, Agent, or Firm* — Invention To Patent Services; Alex Hobson

(57) ABSTRACT

A waterproof electrical connector system enables quick and easy coupling of a first and second housing to electrically connect a first and second electrical cable connected thereto. The electrical cables extend into a fixed portion of the housings and are electrically coupled with a bridging connector that is configured in a rotating portion of the housing. The assembly of the first and second housings has a latch and latch extension that can be moved along a radial portion of a latch channel to a circumferential portion of the latch channel to enable the rotating portions of the housings to be rotated. Upon rotating the rotating portions, the electrical cables are electrically connected by the bridging connector. The two housings may be substantially the same, having the same components and the same geometry. Each housing may have an inner and outer latch channel and latch interface, making operation quick and easy.

20 Claims, 8 Drawing Sheets

(56) References Cited

U.S. PATENT DOCUMENTS

| | | | | | |
|---|---|---|---|---|---|
| 3,821,690 | A | | 6/1974 | Small | |
| 3,954,319 | A | | 5/1976 | Haines | |
| 4,089,341 | A | | 5/1978 | Okaya | |
| 4,142,770 | A | | 3/1979 | Butler, Jr. et al. | |
| 4,192,569 | A | | 3/1980 | Mucci | |
| 4,743,207 | A | * | 5/1988 | Clark | H01R 13/625 439/317 |
| 4,895,530 | A | * | 1/1990 | Gugelmeyer | H01R 13/623 439/311 |
| 5,125,848 | A | | 6/1992 | Zimmerly | |
| 5,150,735 | A | | 9/1992 | Bandy et al. | |
| 5,259,780 | A | | 11/1993 | Landreth et al. | |
| 5,396,927 | A | | 3/1995 | Marshall | |
| 5,829,480 | A | | 11/1998 | Smith, III | |
| 5,833,482 | A | | 11/1998 | Buchter | |
| 5,863,023 | A | | 1/1999 | Evans et al. | |
| 5,865,329 | A | | 2/1999 | Gallusser et al. | |
| 6,109,938 | A | | 8/2000 | Meslet et al. | |
| 6,679,529 | B2 | | 1/2004 | Johnson et al. | |
| 6,790,067 | B2 | | 9/2004 | Douty et al. | |
| 7,025,616 | B2 | * | 4/2006 | Hopper | H01R 13/625 439/318 |
| 7,631,660 | B2 | | 12/2009 | deCler et al. | |
| 7,722,374 | B2 | | 5/2010 | Hillis et al. | |
| 8,951,056 | B2 | | 2/2015 | Pichot et al. | |
| 9,256,932 | B1 | | 2/2016 | Toth | |
| 9,948,012 | B2 | * | 4/2018 | McGregor | H01R 13/5205 |
| 2016/0186906 | A1 | | 6/2016 | Blake et al. | |

* cited by examiner

ELECTRICAL CONNECTOR SYSTEM WITH A LATCH THAT PERMITS ROTATION OF CONNECTOR HOUSINGS INTO ELECTRICAL CONNECTION

CROSS REFERENCE TO RELATED APPLICATIONS

This application claims the benefit of priority to U.S. provisional patent application No. 62/780,685, filed on Dec. 17, 2018; the entirety of which is hereby incorporated by reference herein.

BACKGROUND OF THE INVENTION

Field of the Invention

The invention relates to waterproof electrical connectors that have useful user interfaces for securing and locking a first and second housing together.

Background

Waterproof electrical connectors are typically used to connect an electrical device to a power source. An outlet plug may be coupled to a first electrical cable and an electrical device may be coupled to a second electrical cable. The two electrical cables are typically electrically coupled with contacts within the housing. The two housing components are then joined to form a waterproof electrical connector between the first and second electrical cables. These devices can be difficult to couple together and to lock into a connected orientation to prevent the two components from separating and thereby loosing the waterproof seal.

SUMMARY OF THE INVENTION

The invention is directed to a waterproof electrical connector system comprising a first and a second housing that is easy to join and secure together in a connected, locked and waterproof orientation. The first housing has a first electrical cable that extends into a sealed interior and is coupled with electrical contacts and the second housing has a second electrical cable that extends into a sealed interior and is coupled with electrical contacts. Likewise, the waterproof electrical connector system is easy to unlock and disconnect. The first and a second housing components of the exemplary waterproof electrical connector system may be joined together along a mating surface having a notch and key arrangement to facilitate alignment of the two components. The two housing components may have a circumferential race whereby the rotating portions of each rotate and cross over the mating surface when in a connected position. In an exemplary embodiment, both the first and a second housing components have a rotating portion that rotates to secure the two components together and to make the electrical connection between the first and second cables. The electrical cables are coupled with contacts and bridging connector enables electrical connection between the contacts of the first and second housing when the rotating portion is rotated to a connected position. In an exemplary embodiment, a latch interface is coupled with a latch channel that allows a user to move the latch along the channel and thereby move the rotating portions to connect and disconnect the two housings. The latch channel may have an outer circumferential portion connected with an inner circumferential portion by a radial portion to allow rotation of the rotating portion. A lock may be configured to lock the first housing to the second housing when in a connected position. A lock may automatically engage with the two housing are coupled together and the rotating portion is rotated to a connected position. A lock may comprise a lock extension that extend down into a lock channel to secure the two housing components together.

In an exemplary embodiment, the two connector housings are substantially the same, having the same components and geometry, which makes manufacturing less expensive. Also, this is easier for the consumer as the two identical components are easily coupled together along the mating surfaces and lock by manipulation of one or both of the latch interfaces. For the two housing to be the same, there has to be an inner and an outer circumferential latch channel portion that is coupled together by the radial channel portion. This enables one of the latch extensions to move radially inward to align with the inner circumferential channel portion and the other latch extension to be moved to align with the outer circumferential channel portion, as will be detailed herein.

In an exemplary embodiment, separate electrical cables, having a positive, negative and ground wire extend into the respective first and second housings and are sealed within the interior. Within the interior, the electrical cables are connected with contacts. The contacts in at least one of the housings is electrically coupled with bridging connector that electrically connects the first cable with the second cable when the rotating portion is rotated to a connected position. Individual bridging connectors may extend circumferentially about the rotating portion to make the individual electrical connections between the negative, positive and ground wires. The ground connection may be made first for safety reasons. The exemplary waterproof electrical connector system may comprise two sets of bridging connectors to produce two sets of electrical connections between the first and second cables. The bridging connectors are configured with the rotating portion.

In an exemplary embodiment, both the first and second housing components have a mating surface that may be planar except for a notch and key component. The first housing may have a notch for receiving a key from the second housing and a key for insertion into the corresponding notch on the second housing. The notch and keys may be configured on the portion of the housing that is fixed and does not rotate. A circumferential race may allow a rotating portion to rotate about the two mated fixed portions. The sealed interior may be configured with the fixed component and the first and second cables may extend into the fixed components.

An interface surface of the fixed component with the rotating portion may comprise the bridging connectors that rotate with the rotating portion. In addition, this interface surface may comprise channels for receiving extensions from the user interface latch and/or the lock extension. In this way, the two fixed components are secured together by the rotating portions when in a connected position.

An exemplary latch comprises a latch interface that can be easily manipulated by hand, such as with a person's thumb when holding the waterproof electrical connector. The latch interface may be coupled with a latch extension that extends down into the latch channel in the interface surface of the fixed component. The latch extension may move along an outer circumferential channel portion, along a radial portion to the inner circumferential portion to enable rotation of the rotating portion and configuring the waterproof electrical connector in a connected position. The latch may be coupled with a radial center shaft that extends radially to a central position of the waterproof electrical connector. In an exemplary embodiment, both the first and second housing have a latch and a radial center shaft coupled to the respective latch. The extended ends of these radial center shaft engage with each other, whereby when one of the latches is rotating in the outer circumferential channel the other is rotating in the inner circumferential channel. In this way, the center shaft will extend across the mating surface of the two housing components and will further secure the two housing together. One or both of the latches may be configured with a shaft spring that pushes the latch and center shaft coupled thereto to a ready position. A shaft spring provides an elastic force on the radial center shaft and therefore on the latch interface and may be an actual spring or an elastic material such as urethan, silicone or rubber, for example. An exemplary shaft spring in elastic therefore can be deformed, such as by compression and/or elongation, and will return to an original shape after removal of the deforming load. For example, on the first housing, the shaft spring may push on the center shaft to push the latch radially outward and into the outer circumferential channel, while the second housing comprises a shaft spring that pushes on the center shaft of the second housing radially inward, or to align with the inner circumferential channel. In this way, a user may push on one of both of the latches to counter the spring force of the shaft springs and move both the latches in unison to align with circumferential channels for rotating the rotating portion and placing the waterproof electrical connector in a connected position. Note that the user may only need to push on one of the latches as the two latches are coupled by the interface of the extended ends of the two radial center shafts.

An exemplary latch channel may have a lock indent at the extended end of the inner and/or outer circumferential channel for receiving a latch extension into a locked configuration; whereby the latch would have to be moved manually to overcome the shaft spring force to move the latch and latch extension back along the channel to unlock the waterproof electrical connector. Each of the latch extensions may have a lock indent to provide two separate locking members. As described herein a separate lock may be configured with the rotating portion and may have a lock extension that extends down into a lock channel. A spring lock may allow a lock extension to move past the spring lock to a locked position. A user may have to use a lock interface to move the spring lock out of position to allow the lock extension to again move back along the lock channel to a disconnect position. A user may be able to overcome the spring lock by pushing an effective amount to overcome the spring lock force.

The waterproof electrical connector system enables quick coupling and connecting of the two housing components along the mating surfaces and an easy user interface to rotate the rotating portion to both lock the two housing components together and to make the electrical connection between the two electrical cables thereof. A method of connecting the two housing comprises aligning the two mating surfaces of the two housing components by inserting the respective key or keys into the notches of the opposing mating surface. The latch of one of the housing components can then be moved to overcome the shaft spring force on the latch and to align the latch extension with the inner or outer circumferential channel. This step automatically moves the other latch to the opposing channel. Also, this step moves the radial center shaft interface to extend across the mating surfaces. The two rotating portions can then be rotated to move the bridging connector or connectors to make electrical contact between the two electrical cables. Also, the two rotating portions may be locked into position automatically when rotated to the connected position. The latch extension or lock extension maybe locked rotationally in a fixed position.

Waterproof as used herein, means that water is prevented from entering an interior space of the waterproof electrical connector, such as from rain or from submerging the waterproof electrical connector under water at a depth of 10 cm for about an hour or less.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
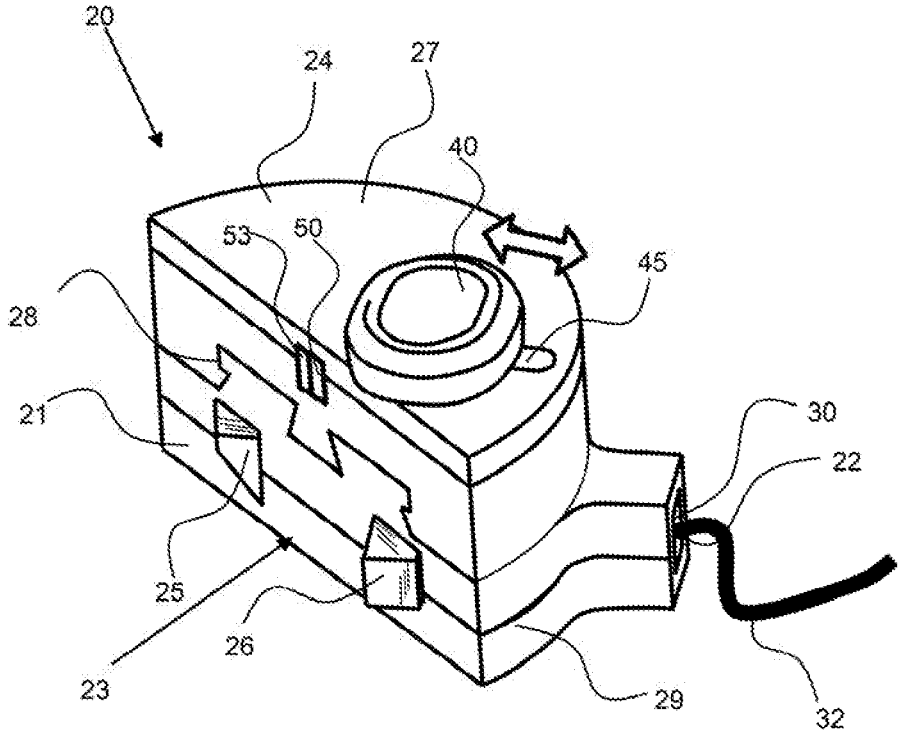
FIG. 1 shows a perspective view of an exemplary first housing having a mating surface with a key and notch for connecting with a second housing portion of the waterproof electrical connector.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," ' having' or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, a first housing portion 20 of an exemplary waterproof electrical connector 10 has a mating surface 23 with a key 26 and notch 25 for connecting with a second housing portion. The second housing portion will have a corresponding key and notch to enable the two mating surfaces to be aligned and retained with each other without slipping. A radial center shaft channel 53 houses a radial center shaft 50 that will extend into the mating surface to secure the two housing together. The center shaft is coupled with the latch interface 40 that slides in an out along a latch U-channel 44, as indicated by the bold arrow. The top plate 24 or the rotating portion 27, is configured to rotate about the circumferential race 28 to enable the electrical connection between the first and second housing. An electrical cable 32 extends into the inlet 30 through the housing wall 29, and into the waterproof interior 22 of the fixed portion 21 of the fist housing portion and is connected to electrical connectors. The inlet 30 around the electrical cable is sealed to create a waterproof interior 22 of the fixed portion.

Figure 2:
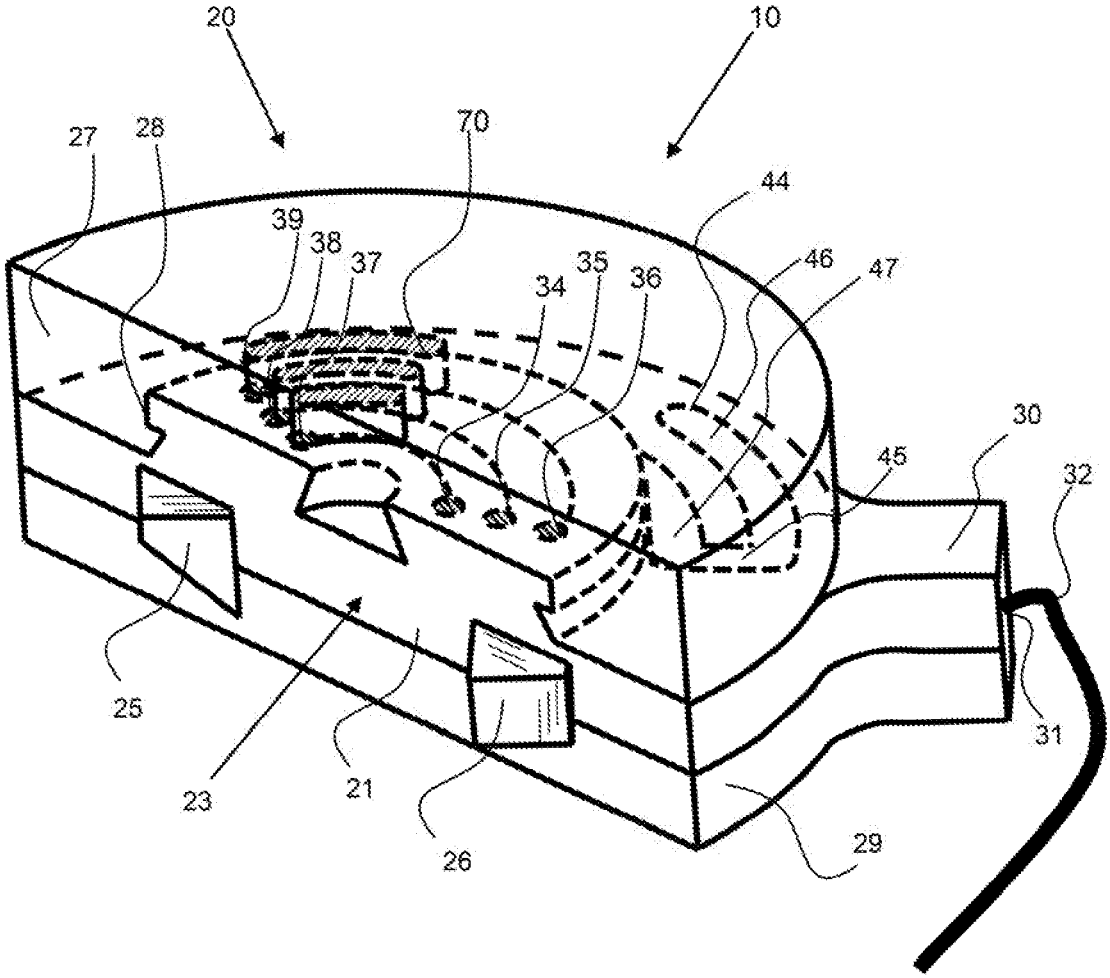
FIG. 2 shows a perspective view of an exemplary first housing and the latch U channel and bridging connector.

As shown in FIG. 2, the first housing is shown without the top plate for ease of illustration. The electrical connections 34, 35, 36, to the first electrical cable 32 are electrically connected with contacts 37, 38, 39. Electrical connection 34 may be a ground connection, electrical connection 35 may be a positive connection and electrical connection 36 may be a negative electrical connection. Likewise, electrical connection 37 may be a ground connection, electrical connection 38 may be a positive connection and electrical connection 39 may be a negative electrical connection A bridging connector 70 will slide with the rotating portion 27 and connect the electrical contacts of a first housing with the corresponding electrical contacts of a second housing. The bridging connector makes an electrical connection between the first and second housing when the rotating portion 27 is rotated about the fixed portion. Also shown in FIG. 2, is the latch U-channel in the fixed portion 21, having a radial portion 45 extending between an outer circumferential portion 46 and an inner circumferential portion 47. A latch extension coupled with a latch interface extends down into the latch U-channel to allow the rotating portion to be rotated in a controlled manner and within fixed limits of rotation.

Figure 3:
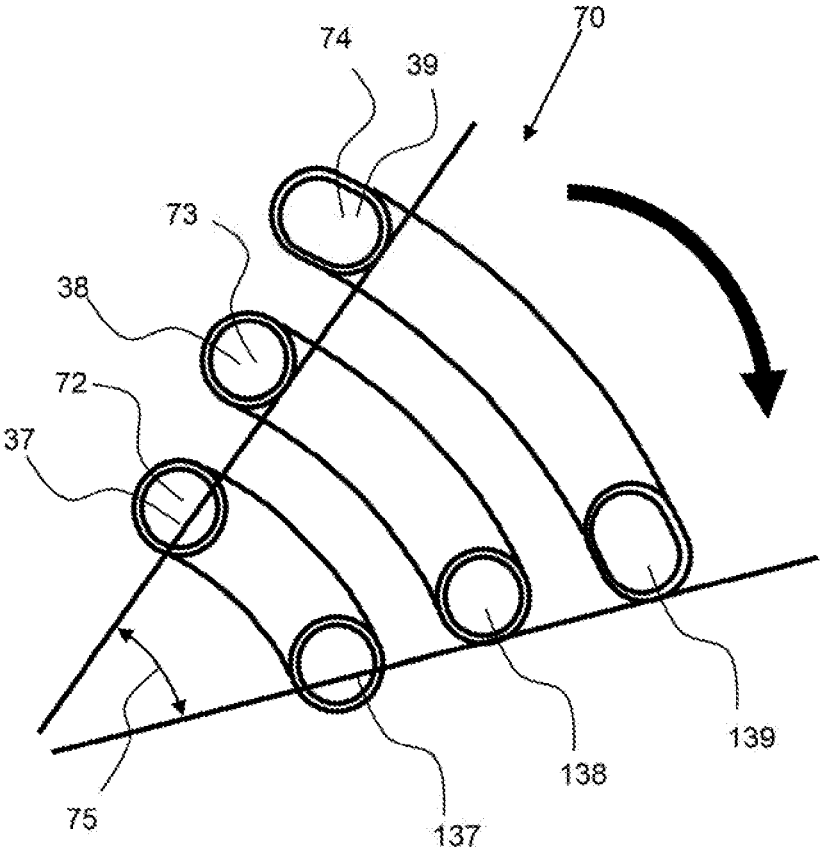
FIG. 3 shows an exemplary bridging connector extending between first and second electrical contacts.

As shown in FIG. 3, the bridging connector 70 comprises three bridging connector components, a ground component 72, positive component 73 and negative component 74. As described herein, the bridging component is configured to make an electrical connection between the first and second housing electrical contacts when the rotating portion of the housing is rotated, as indicated by the bold arrow in FIG. 3. In an exemplary embodiment, the ground component 72 is configured radially inward from the other two components and the contacts and/or the ground bridging component makes electrical contact first for safety reasons. The ground component 72 extends between the ground contact 37 of the first housing and the ground contact 137 of the second housing. The most radially outward bridging component may be negative component 74 and the middle bridging component may the positive bridging component 73. The negative and positive bridging component may connect simultaneously, as shown. The negative component 74 extends between the negative contact 39 of the first housing and the negative contact 139 of the second housing. The positive component 73 extends between the positive contact 38 of the first housing and the negative contact 138 of the second housing. Note that a bridging connector 70 as shown and described may be configured on both the first housing 20 and second housing 04.

Figure 4:
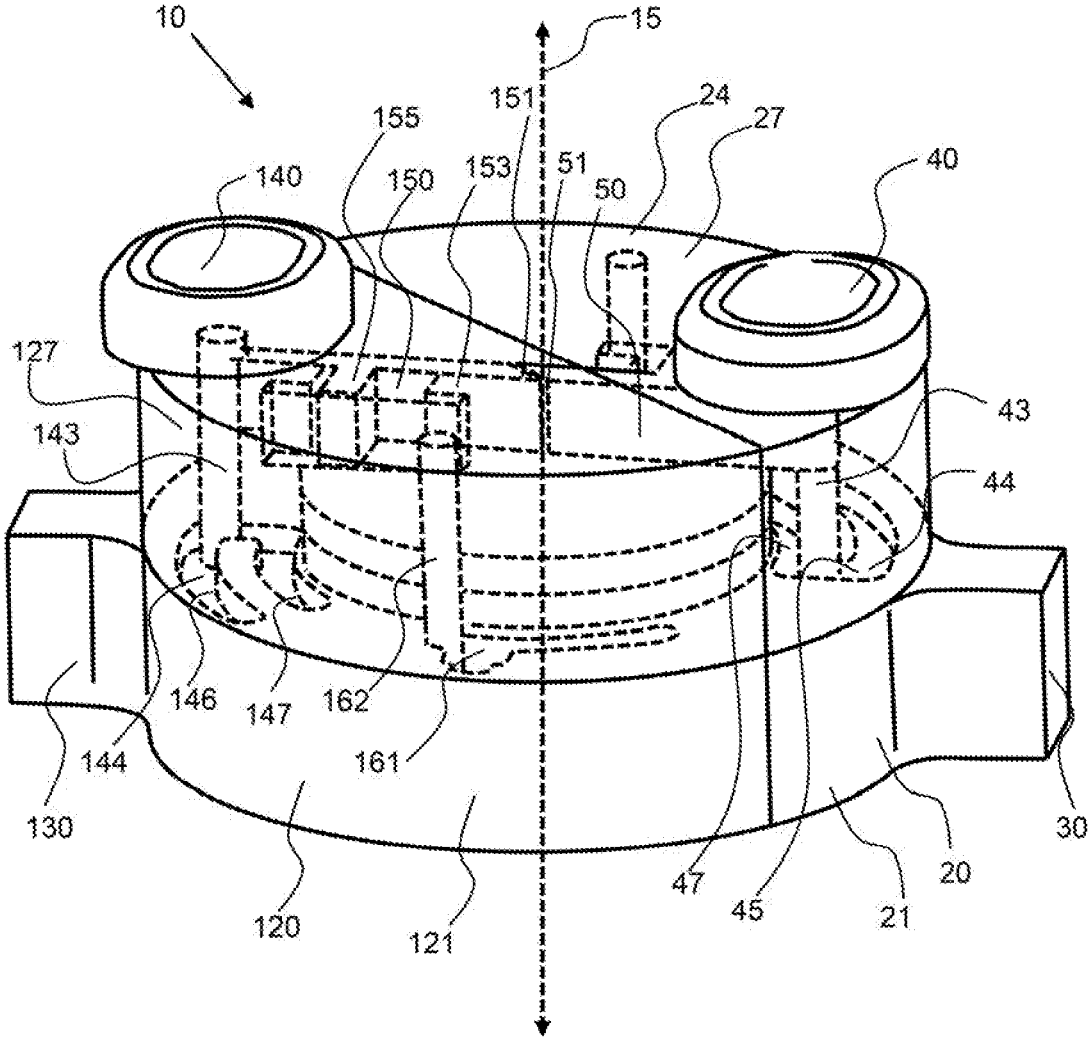
FIG. 4 shows a perspective view of an exemplary waterproof electrical connector.

As shown in FIG. 4, an exemplary waterproof electrical connector has a first housing 20 and a second housing 120 that are coupled together. Each of the housings has a latch interface 40, 140 with a latch extension 43, 143 respectively, coupled thereto. The latch extensions extend down into a latch U-channel 44, 144, that is configured in the interface surface of the fixed portion 21, 121 respectively. The latch extension moves within the latch U-channel to control the rotation of the rotating portions 27, 127. The latch interface is coupled with a radial center shaft 50, 150 that extend radially toward the center of the waterproof electrical connector, or hub. The radial center shaft is moved radially inward or outward when the latch interface is moved along the radial portion 45 of the U-channel. For example, the latch interface 40 of the first housing 20 may be pushed radially inward to force the extended end 51 of the first radial center shaft into the extended end 151 of the second radial center shaft. The latch extension 43 of the first latch interface may be moved along the radial portion of the U-channel to align with the inner circumferential portion 47 of the U-channel while the latch extension 143 of the second latch interface 140 may be moved along the radial portion of the U-channel to align with the outer circumferential portion 146. The rotating portions 27, 127 can then be rotated about the rotational axis 15 to make the electrical connections by the bridging connector, not shown for clarity. An exemplary waterproof electrical connector may have a lock extension 162 coupled with the rotating portion 120 that moves along a lock channel 161 in the fixed portion 121. The lock extension may protrude out from the rotating portion and may be retained in a locked position when the rotating portion in rotated about the rotational axis. A locking feature may retain the lock extension in the locked position to prevent the rotating portion from rotating unintentionally. A force may be required to overcome the locking feature and unlock the rotating portion.

Figure 5:
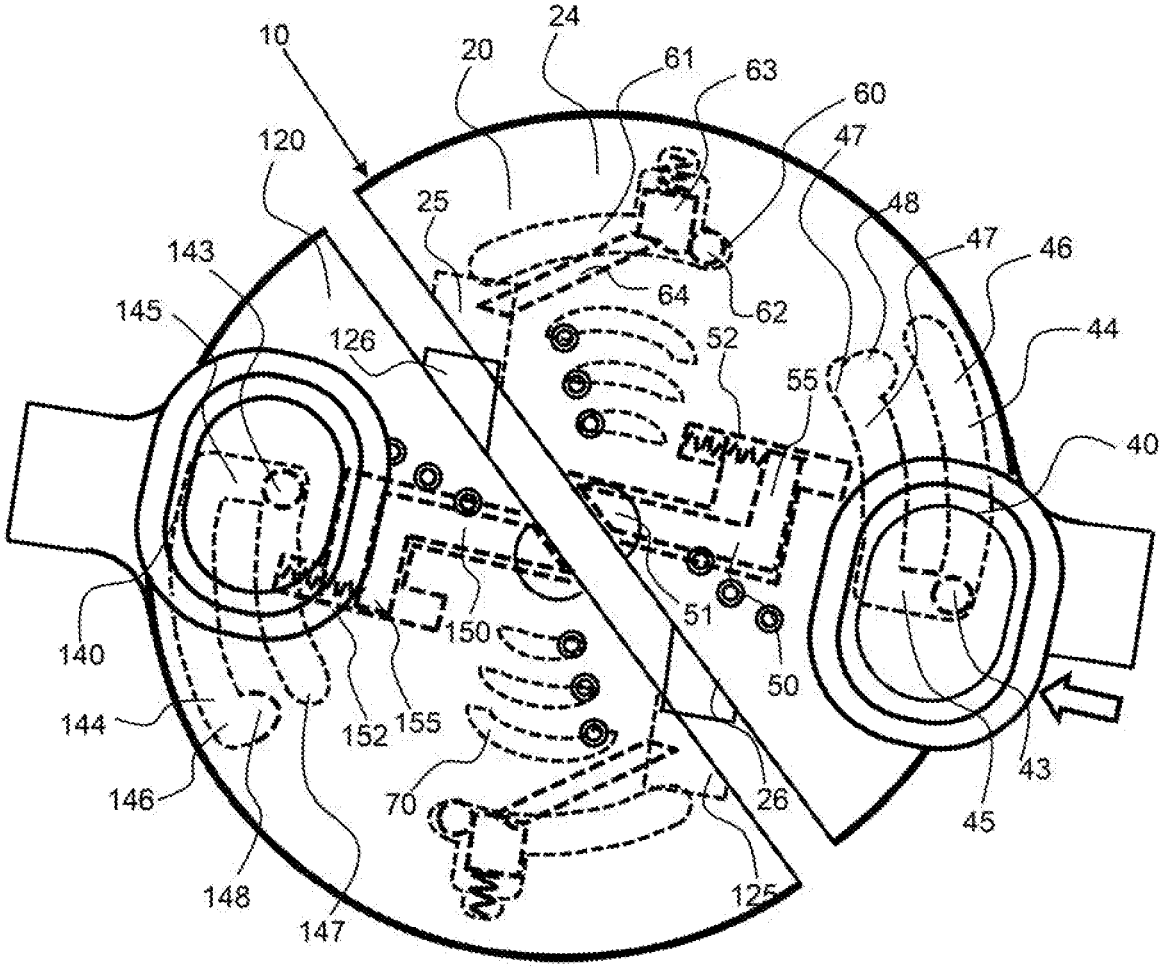
FIGS. 5 to 8 show a top view of an exemplary waterproof electrical connector in consecutive positions to make the electrical connection between the first and second housings and to lock the two housing together.

FIGS. 5 to 8 show the incremental positions of an exemplary waterproof electrical connector 10 as it is rotated to make the electrical connections between the first and second housings. As shown in FIG. 5, the first housing 20 and second housing are aligned for engagement with the key 26 of the first housing aligned with the notch 125 of the second housing and the key of the second housing 126 aligned with the notch 26 of the first housing. The top plate 24 or rotating portion 27 of the first housing is locked in position with respect to the fixed portion by the lock extension 62 that extends from the top plate 24 into a lock channel in the fixed portion. A lock release extension 64, extends from the notch 25 to the spring lock 63 and when the key 126 is inserted into the notch, the key pushes the lock release which pushes open the spring lock to allow the lock extension to now move within the lock channel 61. This same mechanism is configured on the second housing 120.

Figure 6:
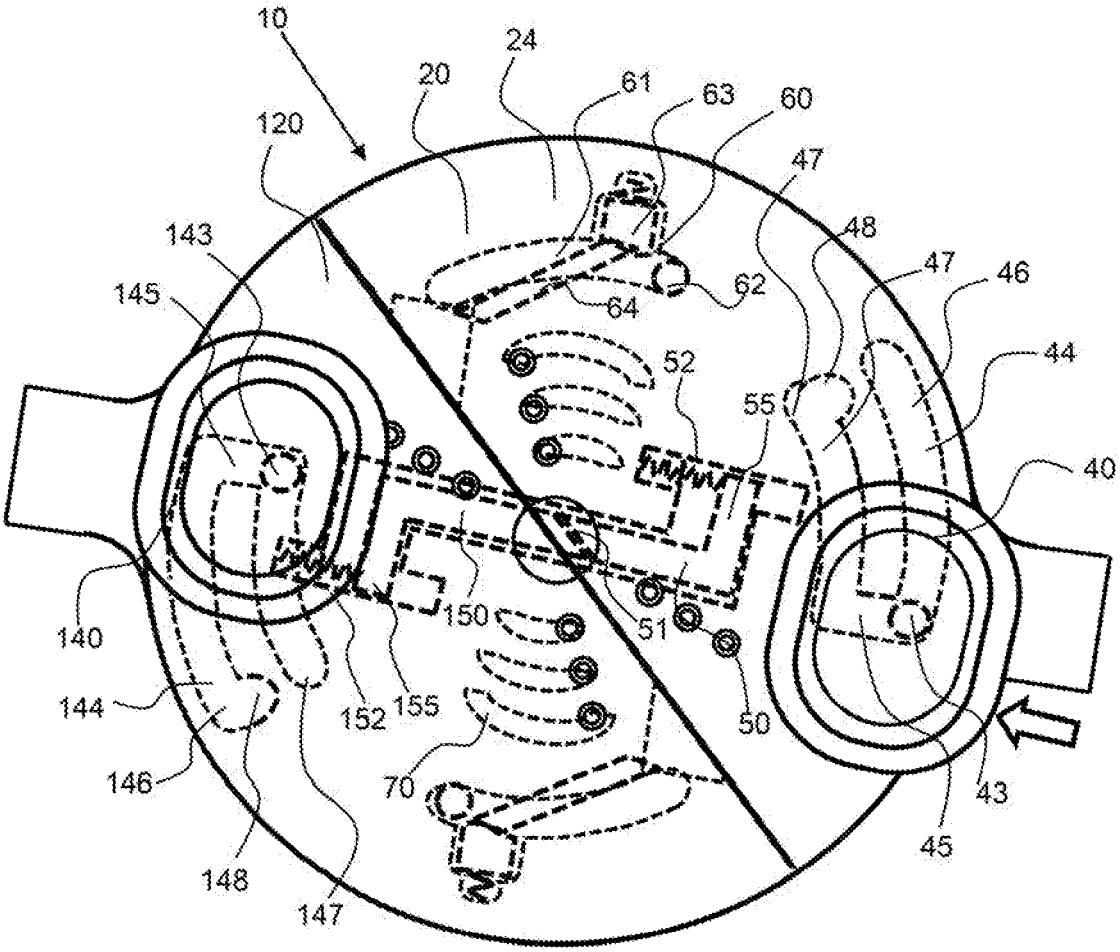

As shown in FIG. 6, a lock 60 comprises a spring lock 63 that is pushed open by the lock release extension 64. The waterproof electrical connector is now configured in a mated configuration with the mating surfaces pressed against each other and the key inserted in the notch between the two housings. In FIG. 6, the two latch interfaces, 140 and 40 are in a ready or default position, with latch extension 40 pushed back by the shaft spring 52 pushing on the shaft arm 55 of the fist radial center shaft 50 and latch extension 140 pushed forward by the shaft spring 152 pushing on the shaft arm 155 of the second radial center shaft 150. Both of the latch extensions 40, 140 are in the radial portion 45, 145. Note that the interface of the extended ends 51 is pushed over into the first housing portion 20.

Figure 7:
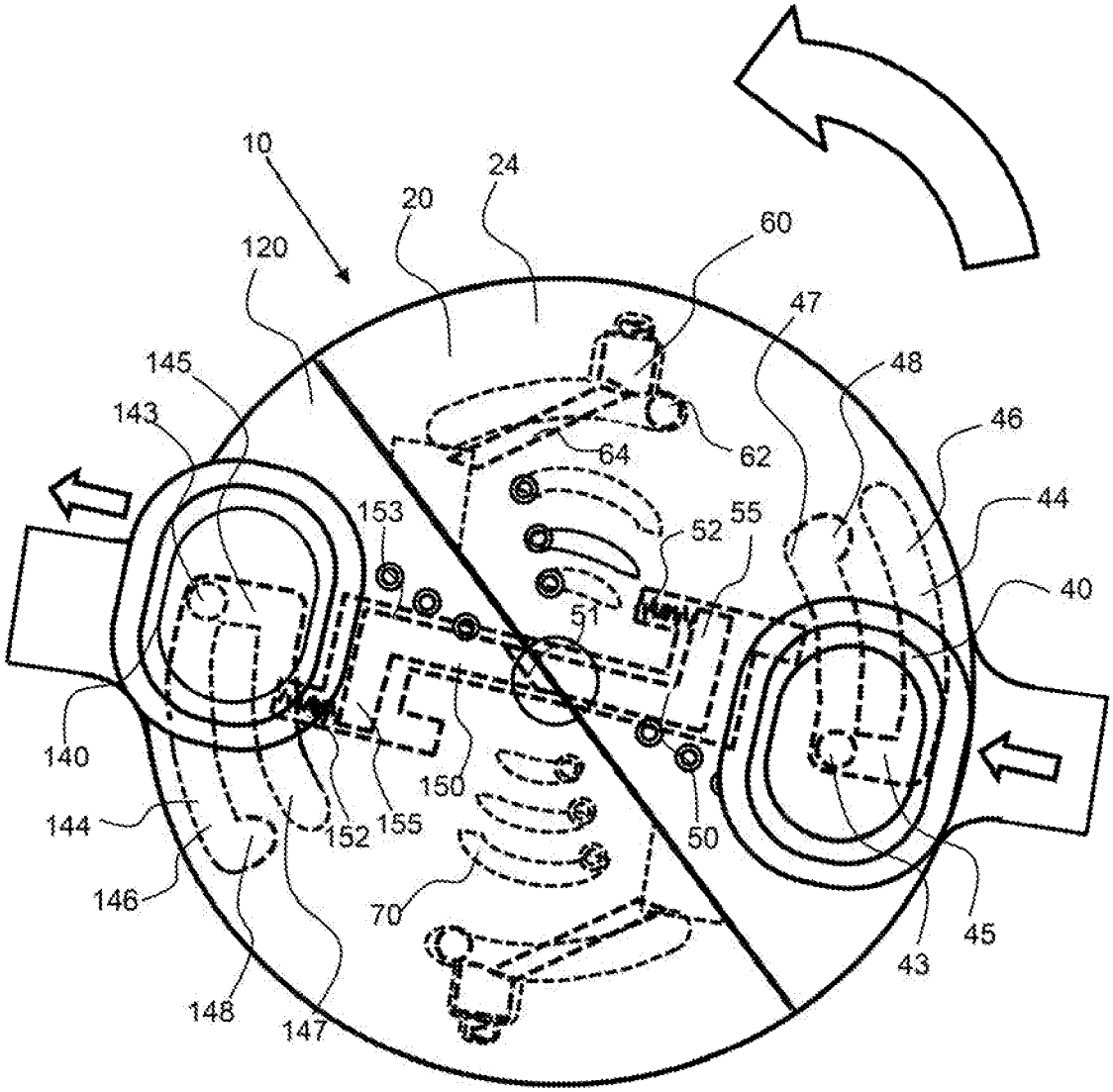

As shown in FIG. 7, the waterproof electrical connector is in an intermediate position with the two housings mated together with the latch interfaces moved along the radial portion of the latch channel by the latch interface. As shown in FIG. 7, the first latch interface 40 is pushed radially inward and this forces the second latch interface 140 to move radially outward, as the first radial center shaft 50 pushes on the second radial center shaft 150. The extended end 51 of the first radial center shaft 50 is now configured in the shaft channel 153 of the second housing. Also, the first latch extension 43 is now aligned with the inner circumferential portion 47 of the first U-channel 44 and the second latch extension 143 is aligned with the outer circumferential portion 146 of the second U-channel 140. The rotating portion can now be rotated counter clockwise, as indicated by the large arrow. Note that the U-channel 144 has an inner circumferential portion 147 and outer circumferential portion 146.

Figure 8:
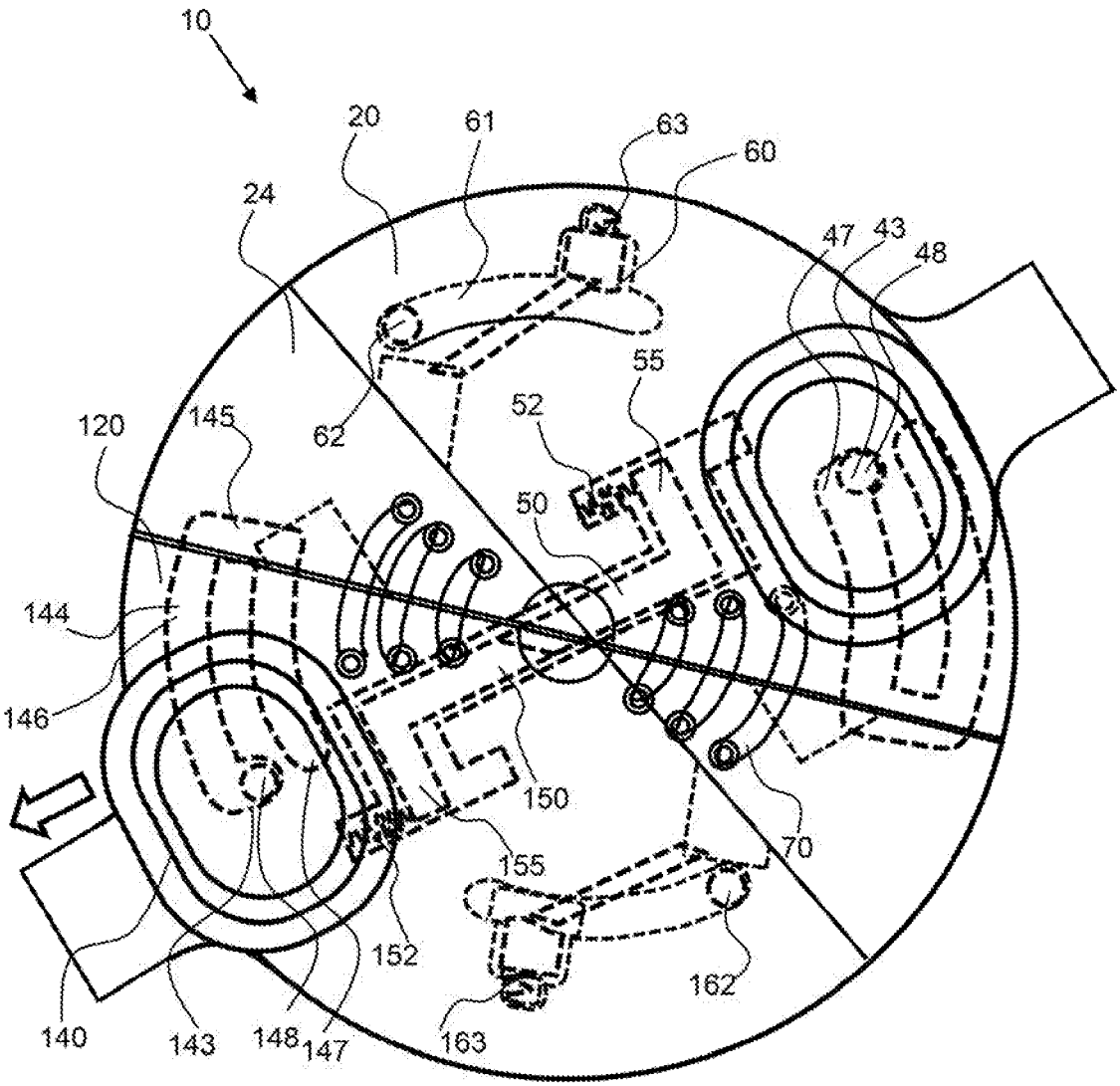

As shown in FIG. 8, the waterproof electrical connector is in a connected position or configuration. After rotating, as shown in FIG. 8, the latch extensions 43. 143 have moved along the corresponding U-channel portions and the bridging connector 70 has rotated to connect the first electrical contacts of the first housing with the second electrical contacts of the second housing. As shown in FIG. 8, the latch extensions are configured in the lock indents 48, 148 of the respective latch U-channels 44, 144. This indent will require a user to move the latch to overcome the shaft spring force to rotate the rotating portion to unlock the waterproof electrical connector. The lock extensions 62, 162 have moved past the spring lock 63, 163 and are now in a locked configuration. Again, a force may be required to overcome this locked configuration.

The latch channel may be a U-channel or may comprise only the radial portion couple with the corresponding inner or outer circumferential portions. For example, the first housing portion may have a latch channel having a radial portion that extends to an inner circumferential portion and the second housing portion may have a latch channel having a radial portion that extends to an outer circumferential portion. For manufacturing simplicity, the two housing portions may be manufactured with U-channels.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A waterproof electrical connector system comprising:

a) a first housing and a second housing, each housing comprising:

i) a fixed portion comprising:

a mating surface;

an interior;

an inlet through a housing wall for receiving an electrical cable extending into said interior;

an electrical connection to said electrical cable including:

a positive connection; and a negative connection;

ii) a rotating portion coupled to the connector portion by a circumferential race, wherein the rotating portion is configured to rotate about the fixed portion along the radial race and about an axis of rotation;

b) a bridging connector electrically coupled to the electrical connection of the first housing;

wherein the bridging connector electrically connects the electrical connections of the first and second housings when the rotating portion is rotated to a connected position;

c) a first latch configured on the first housing and comprising:

a first latch channel having a radial portion and a circumferential portion;

a first latch interface;

a first latch extension coupled with the first latch interface and that extends into said first latch channel;

a first radial center shaft that is coupled with the first latch interface and extends radially toward an axis of rotation to an extended end;

a first shaft spring coupled with the first radial center shaft;

wherein the first latch extension is configured to be moved by the first latch interface along the radial portion of the first latch channel to align with the circumferential portion of the first latch channel to enable the rotating portion to be rotated about the axis of rotation to move the bridging connector and electrically connect the electrical cables of the first and second housings.

2. The waterproof electrical connector system of claim 1, wherein the mating surfaces of the first housing and second housing each comprise a key and a notch for aligning the mating surfaces of the first and second housings.

3. The waterproof electrical connector system of claim 1, further comprising a lock comprising a lock extension that extends into a lock channel and a spring lock that holds the lock extension in a fixed position to prevent the rotating portion from rotating by said lock until the first and second housings are coupled together by the keys being inserted into the respective notches.

4. The waterproof electrical connector system of claim 1, further comprising a lock indent configured on the first latch channel to receive the first latch extension when the rotated portion is rotated to a connected position; whereby the shaft spring pushes the latch extension into the lock indent.

5. The waterproof electrical connector system of claim 1, wherein the electrical connection to said electrical cable includes a ground connection.

6. The waterproof electrical connector system of claim 5, wherein the bridging connector connects the positive connection, the negative connection and the ground connection.

7. The waterproof electrical connector system of claim 6, wherein the ground connection is connected prior to the negative connection when the rotating portions are rotated to a connected position.

8. The waterproof electrical connector system of claim 1, comprising a second latch configured on the second housing and comprising:

a second latch channel having a radial portion and a circumferential portion;

a second latch extension that extends into said second latch channel;

a second radial center shaft that is coupled with the second latch extension and extends radially toward an axis of rotation to an extended end;

wherein the extended end of the first radial center shaft interfaces with the extended end of the second radial center shaft;

wherein the second radial center shaft of the second housing is moved by movement of the first latch interface and thereby moves the second latch extension of the second housing;

wherein the second latch extension is configured to be moved along the radial portion of the second latch channel to align with the circumferential portion of the second latch channel to enable the rotating portion to be rotated about the axis of rotation.

9. The waterproof electrical connector system of claim 8, wherein the extended end of the fist radial center shaft extends into the second housing to move the second latch extension along the radial portion of the second latch channel.

10. The waterproof electrical connector system of claim 8, wherein the second latch comprises a second latch interface that is coupled with the second latch extension and the second radial center shaft.

11. The waterproof electrical connector system of claim 8, further comprising a second shaft spring that pushes on the second radial center shaft.

12. The waterproof electrical connector system of claim 11, wherein the first housing and second housing each comprise an inner circumferential portion and an outer circumferential portion coupled together by said radial portion.

13. The waterproof electrical connector system of claim 12, wherein the first housing and second housings are substantially the same shape.

14. A method of producing a waterproof connection between two electrical cables comprising:

a) providing a waterproof electrical connector system comprising:

i) a first housing and a second housing, each housing comprising:

a fixed portion comprising:

a mating surface;

an interior;

an inlet through a housing wall having an electrical cable extending into said interior;

an electrical connection to said electrical cable including:

a positive connection; and a negative connection;

ii) a rotating portion coupled to the connector portion by a circumferential race, wherein the rotating portion is configured to rotate about the fixed portion along the radial race and about an axis of rotation;

b) a bridging connector electrically coupled to the electrical connection of the first housing;

wherein the bridging connector electrically connects the electrical connections of the first and second housings when the rotating portion is rotated to a connected position;

c) a first latch configured on the first housing and comprising:

a first latch channel having a radial portion and a circumferential portion;

a first latch interface;

a first latch extension coupled with the first latch interface and that extends into said first latch channel;

a first radial center shaft that is coupled with the first latch interface and extends radially toward an axis of rotation to an extended end;

a first shaft spring coupled with the first radial center shaft;

b) aligning and coupling together the mating surfaces of the first and second housings;

c) moving the latch interface along the radial portion of the latch channel to align the latch extension with the circumferential portion of the latch channel;

d) moving the latch interface along the circumferential portion of the latch channel to rotate the rotating portion of both the first and second housings to move the bridging connector and electrically connect the electrical cables of the first and second housings.

15. The method of producing a waterproof connection between two electrical cables of claim 14, further comprising a lock indent configured on the first latch channel to receive the first latch extension when the rotated portion is rotated to a connected position; whereby the shaft spring pushes the latch extension into the lock indent.

16. The method of producing a waterproof connection between two electrical cables of claim 14, wherein the mating surfaces of the first housing and second housing each comprise a key and a notch, and wherein aligning and coupling together the mating surfaces of the first and second housings includes inserting the keys into the respective notches.

17. The method of producing a waterproof connection between two electrical cables of claim 16, further comprising a lock comprising a lock extension that extends into a lock channel and a spring lock that holds the lock extension in a fixed position to prevent the rotating portion from rotating by said lock until the first and second housings are coupled together by the keys being inserted into the respective notches.

18. The method of producing a waterproof connection between two electrical cables of claim 14, further comprising a second latch configured on the second housing and comprising:

a second latch channel having a radial portion and a circumferential portion;

a second latch extension coupled that extends into said second latch channel;

a second radial center shaft that is coupled with the second latch extension and extends radially toward an axis of rotation to an extended end;

wherein upon moving the first latch interface along the radial portion of the latch channel to align the first latch extension with the circumferential portion of the first latch channel, the extended end of the first radial center shaft interfaces with the extended end of the second radial center shaft;

wherein the second radial center shaft of the second housing is moved by movement of the first latch interface and thereby moves the second latch extension of the second housing;

wherein the second latch extension is moved along the radial portion of the second latch channel to align with the circumferential portion of the second latch channel; and wherein upon moving the latch interface along the circumferential portion of the latch channel to rotate the rotating portion of both the first and second housings, the second latch extension moves within the circumferential portion of the second latch channel.

19. The method of producing a waterproof connection between two electrical cables of claim 18, wherein upon moving the first latch interface along the radial portion of the latch channel to align the first latch extension with the circumferential portion of the latch channel, the extended end of the first radial center shaft extends into second shaft channel of the second housing.

20. The method of producing a waterproof connection between two electrical cables of claim 19, wherein the second latch comprises a second latch interface that is coupled with the second latch extension and the second radial center shaft.

* * * * *